United States Patent [19]

Clowes

[11] Patent Number: 4,685,322

[45] Date of Patent: Aug. 11, 1987

[54] METHOD OF FORMING A DRAWN AND REDRAWN CONTAINER BODY

[75] Inventor: Ernest J. Clowes, Lower Burrell, Pa.

[73] Assignee: Aluminum Company of America, Pittsburgh, Pa.

[21] Appl. No.: 771,633

[22] Filed: Sep. 3, 1985

[51] Int. Cl.[4] ..... B21D 22/21

[52] U.S. Cl. ..... 72/348; 72/349

[58] Field of Search ..... 72/347, 348, 349

[56] References Cited

U.S. PATENT DOCUMENTS

| | | | |
|---|---|---|---|
| 1,999,229 | 4/1935 | Benedict | 72/349 |
| 2,872,887 | 2/1959 | Praturlon | 72/349 |
| 3,811,393 | 5/1974 | Close | 72/349 |
| 3,905,507 | 9/1975 | Lyu | 220/66 |
| 3,998,174 | 12/1976 | Saunders | 72/349 |
| 4,099,475 | 7/1978 | Lee, Jr. | 113/116 |
| 4,151,927 | 5/1979 | Cvacho et al. | 220/70 |
| 4,177,746 | 12/1979 | Lee, Jr. et al. | 113/120 |
| 4,294,373 | 10/1981 | Miller et al. | 220/70 |
| 4,372,143 | 2/1983 | Elert et al. | 72/343 |
| 4,503,702 | 3/1985 | Bulso | 72/349 |

*Primary Examiner*—Lowell A. Larson
*Attorney, Agent, or Firm*—Max L. Williamson

[57] ABSTRACT

A method of forming a drawn and redrawn container body which includes forming an inwardly projecting annular bead in the end wall of a drawn cup to be redrawn in order to prevent wrinkling in the end wall when it is subsequently formed into a pressure-resistant profile.

11 Claims, 7 Drawing Figures

METHOD OF FORMING A DRAWN AND REDRAWN CONTAINER BODY

BACKGROUND OF THE INVENTION

This invention relates to a method of forming a drawn and redrawn container body from a metal blank. More particularly, it relates to a method of preventing wrinkles during forming of the bottom end wall of a drawn and redrawn container body.

It is well known to draw and iron a sheet metal blank to make a thin-walled can body for packaging carbonated beverages. It is also well known that metal manufacturers, can makers and carbonated beverage packagers have had and continue to have a goal to reduce the weight of the container and thereby reduce the cost of packaging. At least one way to reduce weight is to form a profile in the bottom end wall which is capable of strengthening the end wall's resistance against buckling from internal pressure. By so doing, thinner metal can be used to make the can and thereby reduce weight and cost. U.S. Pat. Nos. 3,905,507; 4,099,475; 4,151,927; 4,177,746 and 4,294,373 are but a few of the many which are concerned with a bottom end wall profile or method of making such a profile.

Many of the end wall profiles include an annular portion which slopes generally inwardly and downwardly from the can sidewall and an inwardly projecting profiled portion, such as a dome, for example, circumscribed by such annular portion. The thinner the metal from which containers are made, the greater the tendency for the metal in the inwardly and downwardly projecting annular wall to wrinkle during redrawing and doming. Elert et al U.S. Pat. No. 4,372,143 is a patent which proposes a solution to this problem. The Elert et al solution involves adapting the apparatus used to form the dome so as to support the beveled annular wall with a pressure ring while the dome is being formed.

SUMMARY OF THE INVENTION

The present invention is a method for drawing and redrawing a metal blank to form a can body having a bottom end which includes an annular wall portion which extends generally inwardly and downwardly from the can body sidewall. The method may also include ironing the sidewall, and the inwardly and downwardly extending wall may be flat or arcuate. In a first step of this invention, a cup is drawn from a metal blank. Included in the first step, or as a step prior to redrawing the cup, an annular inwardly projecting bead is formed in the cup end wall. The bead is located in a portion of the end wall which will be formed into the inwardly and downwardly extending wall as the cup is redrawn. The function of the bead is to provide metal sufficient in a portion of the end wall subject to high stresses during redrawing to prevent wrinkling from occurring in such portion during redraw.

It is an objective of this invention to prevent wrinkling in the end of a can body during redrawing.

It is an advantage of this invention that thinner metal may be used to make a can body than might otherwise be acceptable.

These and other objectives and advantages of this invention will be more fully understood and appreciated with reference to the following description and associated drawings.

DESCRIPTION OF A PREFERRED EMBODIMENT

For ease of description and illustration, the invention will be described with respect to making a drawn and ironed beverage can, but it is understood that its application is not limited thereto.

In a typical manufacturing method of making a drawn and ironed can body, a light gauge blank, such as 0.0126 inch 3004-H19 aluminum alloy, is first drawn into a cup. The cup is then transferred to a body maker comprised of a punch adapted to move longitudinally and force the cup through a redraw die followed by coaxially aligned ironing rings. As the redrawn cup is forced through the ironing rings, the sidewall is thinned and a bottom forming die cooperates with the punch to produce a desired profile in the can body end wall.

Figure 1:
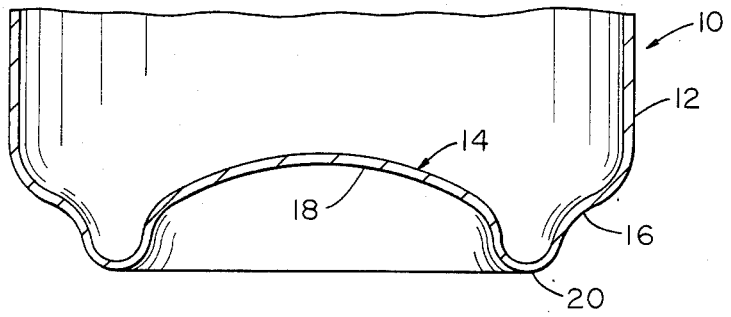
FIG. 1 is a cross-sectional view of a bottom and sidewall portion of a drawn and ironed can body having an internal pressure-resistant end wall.

By practicing a method of this invention, 0.010 inch thick, rather than 0.0126 inch thick, aluminum alloy 3004-H19 has been successfully formed into a can body which results in metal savings in at least the end wall portion of the can body. In FIG. 1, can body 10 has a drawn and ironed sidewall 12 and a drawn and redrawn bottom end wall 14 having an internal pressure-resistant profile. The bottom end wall includes an outer annular portion 16 extending generally inwardly and downwardly from the sidewall, an inwardly projecting dome portion 18, and an arcuate portion 20 connecting the outer annular portion with the dome portion.

Figure 2:
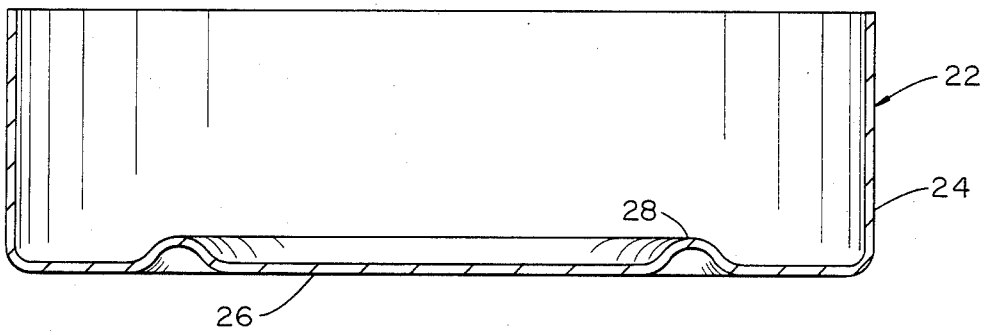
FIG. 2 is a cross-sectional view of a drawn cup having an inwardly projecting bead in the end wall, which cup is used to form the can body partially shown in FIG. 1 by a method of this invention.
Figure 6:
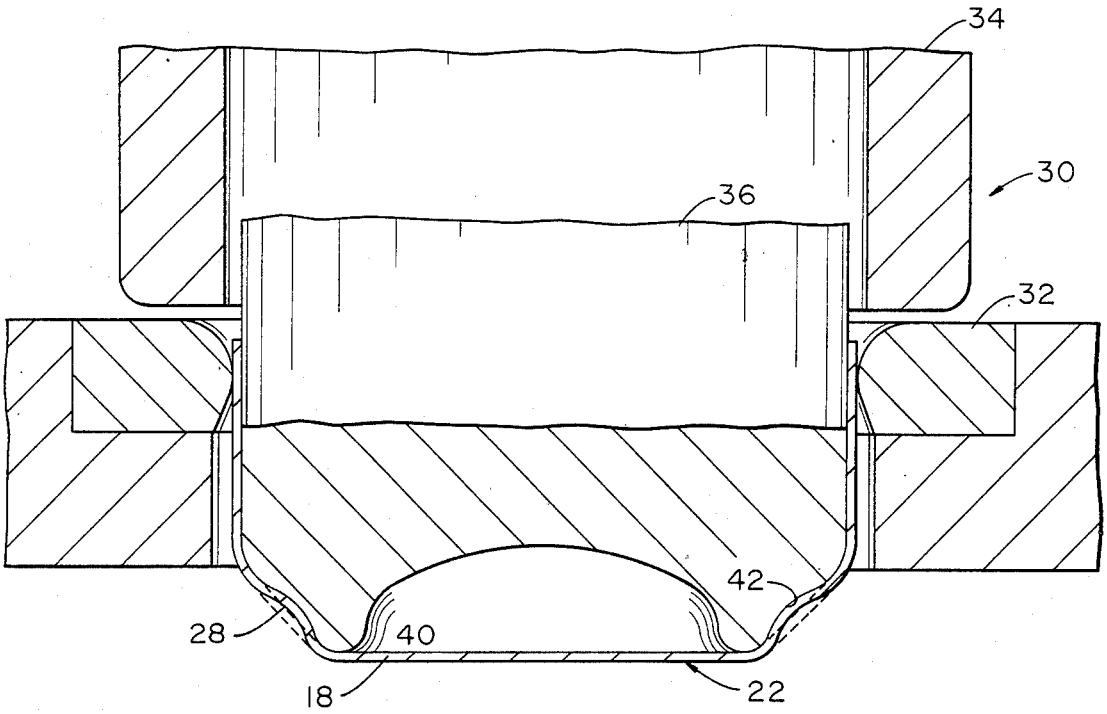
FIG. 6 is a cross-sectional view of the body maker shown in FIG. 5 with the cup near completion of passing through the redraw ring.

As a first step in making the can body shown in FIG. 1, a cup 22 having a profile in cross section as shown in FIG. 2 is produced by any suitable drawing method. The cup 22 is comprised of a sidewall 24 and an end wall 26 having an annular inwardly projecting bead 28 therein. The bead 28 is generally located in the portion of the end wall 26 which will be formed into the inwardly and downwardly extending wall 28 during redrawing of the cup, as shown in FIG. 6. As another point of reference for locating the bead, the preferred position is adjacent to and outward of the portion of the punch which forms the arcuate end wall connecting portion 20, as will now be explained.

Figure 3:
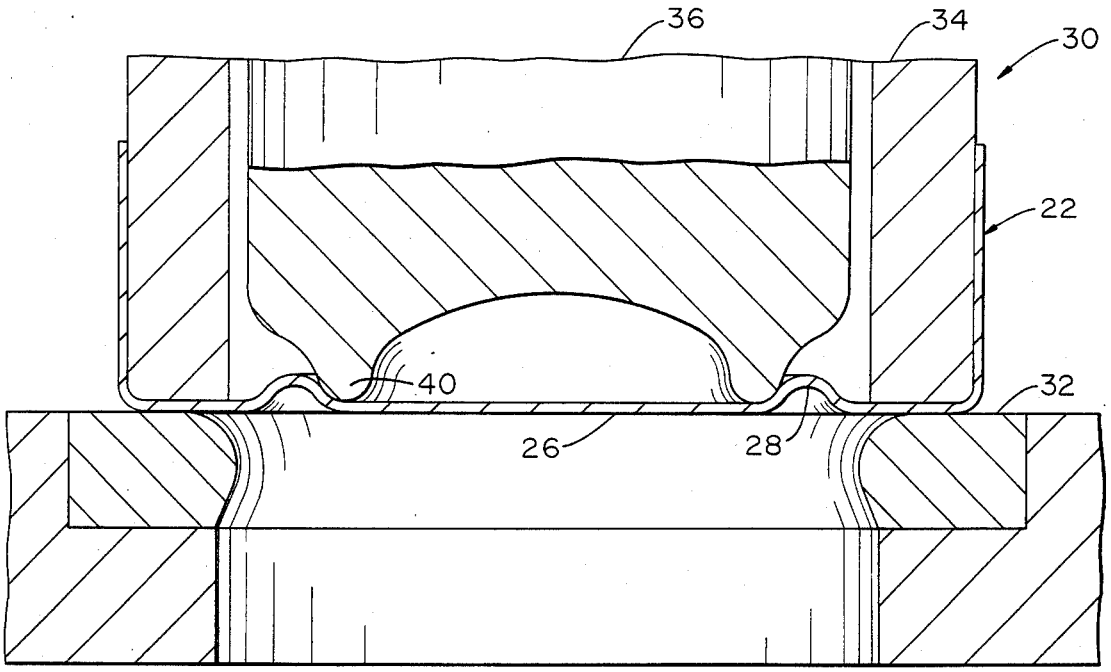
FIG. 3 is a cross-sectional view of the cup shown in FIG. 2 mounted in a body maker prior to being formed into a can body by a method of this invention.

In FIG. 3, the cup 22 is shown mounted on a body maker 30 prior to being formed into a finished can body.

Figure 7:
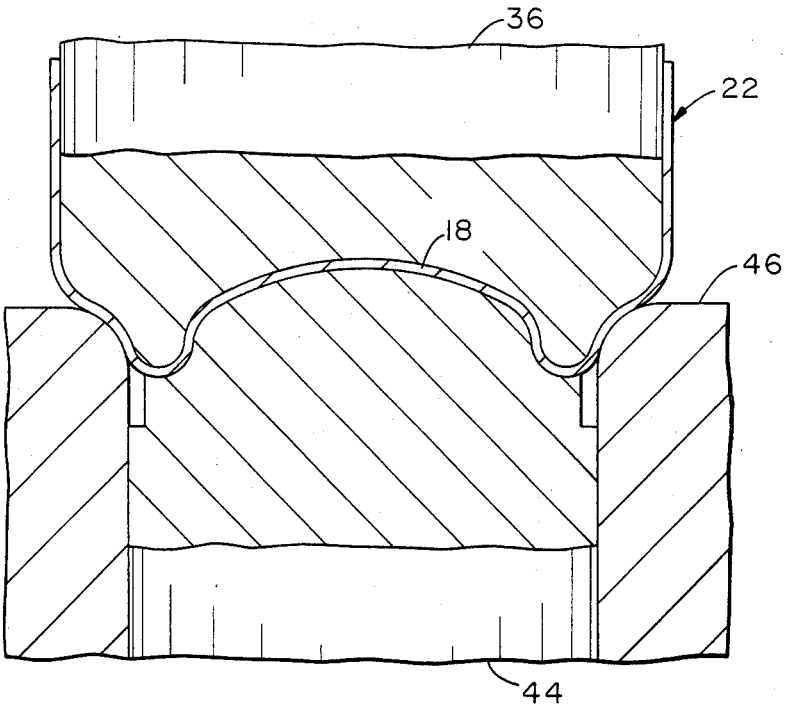
FIG. 7 is a cross-sectional view of a redrawn and ironed can body in the doming tool portion of a body maker.

The cup is supported on a redraw ring 32 and is held in a coaxial position therewith by a hold-down sleeve 34. A punch 36, which is adapted for longitudinal motion with respect to the sleeve, is shown in contact with the cup end wall 26 preparatory to forcing the cup through the redraw ring 32. In this FIG. 3, only the redraw portion of the body maker is shown. Typically, a body maker includes one or more ironing rings coaxially aligned with the redraw ring, with each ring having a slightly smaller diameter than the preceding ring in order to thin the sidewall. As shown in FIG. 7, the inwardly projecting dome 18 of the can body is formed by pressing the end wall of the drawn and ironed body against a doming tool 44 contained within a sleeve 46 after the body has passed through the last ironing ring. It is noted that the inwardly projecting bead 28 on the cup is outwardly of and adjacent to the annular forming ridge 40 projecting outwardly from the punch end.

Figure 4:
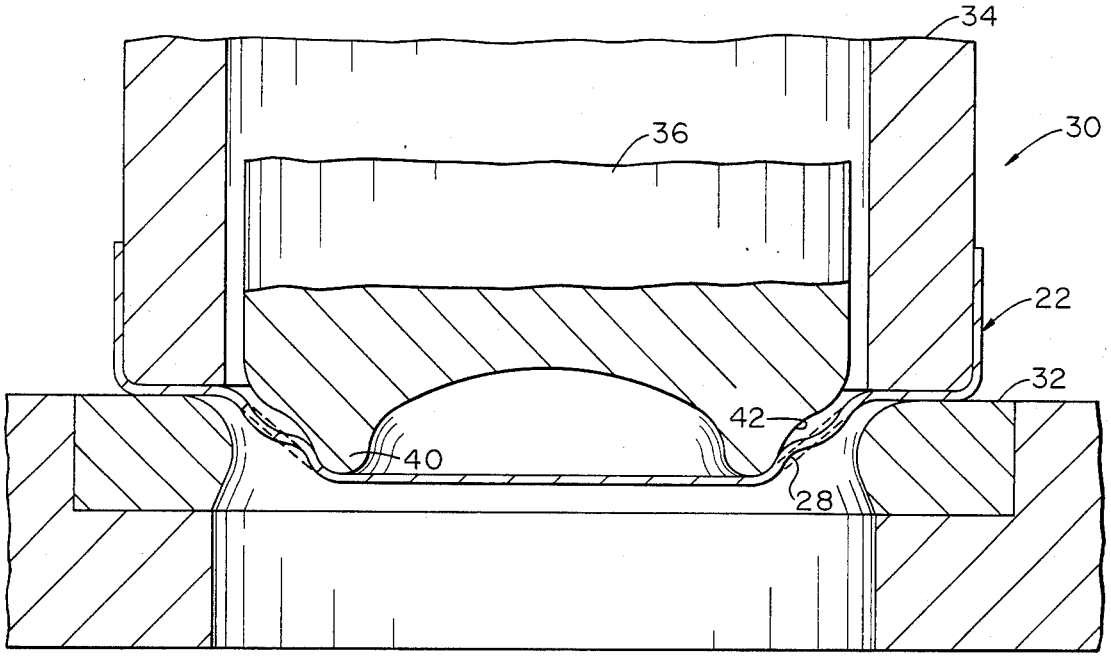
FIG. 4 is a cross-sectional view of the body maker shown in FIG. 3 with the cup in an intermediate stage of being redrawn.
Figure 5:
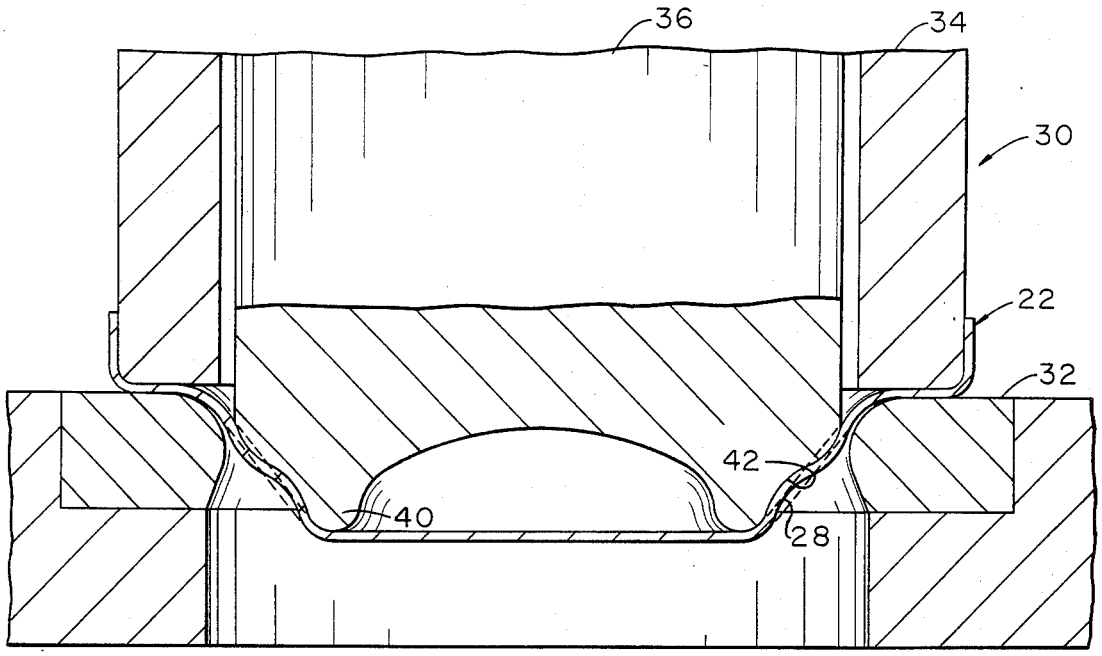
FIG. 5 is a cross-sectional view of the body maker shown in FIG. 4 with the cup in a further sequential intermediate stage of being redrawn.

FIGS. 4, 5 and 6 show sequential positions of the punch 36 as it acts upon the cup 22 forcing it through the redraw ring 32. The cup end wall adjacent the bead 28 is bent by the advancing punch forming ridge 40 causing the bead to press against and conform to the annular arcuate outer surface 42 of the ridge. It may be seen that if the bead 28 were not provided, the wall extending inwardly and downwardly from the cup sidewall as the cup is redrawn would be straight, as shown by the dotted lines. As a result, such metal would be unsupported by the tool and, as redraw progresses, the tendency for such metal to wrinkle increases. The thinner the metal, the greater is the tendency to wrinkle. As reforming of the cup 22 progressively continues, as shown in FIGS. 5 and 6, the bead 28 is reformed to conform to the shape of the annular arcuate surface 42 of the punch. Forming by the foregoing method of this invention makes it possible to use 0.010 inch thick 3004-H19 aluminum in making a can body without wrinkling profiled portions of the end wall. Attempts to consistently produce can bodies from 0.010 inch thick 3004-H19 blanks without wrinkles in the end wall had not been successful heretofore.

While the invention has been described in terms of preferred embodiments, the claims appended hereto are intended to encompass all embodiments which fall within the spirit of the invention.

What is claimed is:

1. A method of forming a drawn and redrawn container body comprising providing a drawn cup having a sidewall and an end wall having an inwardly projecting bead therein and redrawing said cup into a container body having a profiled bottom end wall.

2. A method as claimed in claim 1 which includes ironing the sidewall of the redrawn cup.

3. A method as claimed in claim 1 whereby the method includes forming an end wall portion of the redrawn cup to extend inwardly and downwardly from the sidewall of the container body.

4. A method as claimed in claim 3 whereby the method further includes providing the inwardly projecting bead on the cup end wall in the area which will be formed into the portion extending inwardly and downwardly from the sidewall of the container body as the cup is redrawn.

5. A method as claimed in claim 3 which further includes forming an end wall portion of the cup into an inwardly projecting dome in the container body end wall.

6. A method of forming a drawn and redrawn container body, comprising:

drawing a cup having a sidewall and an end wall;

forming an inwardly projecting annular bead in the end wall;

redrawing the cup to form a container body having a diameter less than the cup diameter;

reforming the inwardly projecting annular bead to form an end wall portion in the container body which extends downwardly and inwardly from the sidewall.

7. A method of forming as claimed in claim 6 whereby the drawing step and forming of the inwardly projecting annular bead step are performed in a single step.

8. A method of forming as claimed in claim 6 whereby the redrawing step and the reforming step of reforming the inwardly projecting annular bead are performed in a single step.

9. A method of forming as claimed in claim 6 which further includes ironing the sidewall of the redrawn container.

10. A method of forming as claimed in claim 6 which further includes forming an inwardly projecting dome in a central portion of the container body end wall circumscribed by the portion extending downwardly and inwardly from the sidewall.

11. A method of forming as claimed in claim 6 in which the drawing step includes drawing a cup from an aluminum alloy blank having a thickness of 0.0125 inch or less.

* * * * *